US009134682B2

(12) United States Patent
Watanabe

(10) Patent No.: US 9,134,682 B2
(45) Date of Patent: Sep. 15, 2015

(54) IMAGE FORMING APPARATUS WITH LOW VOLTAGE POWER SUPPLY BOARD AND FRAME

(71) Applicant: Keisuke Watanabe, Obu (JP)

(72) Inventor: Keisuke Watanabe, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 6 days.

(21) Appl. No.: 14/024,695

(22) Filed: Sep. 12, 2013

(65) Prior Publication Data

US 2014/0079433 A1 Mar. 20, 2014

(30) Foreign Application Priority Data

Sep. 14, 2012 (JP) ..... 2012-202802

(51) Int. Cl.
*G03G 15/00* (2006.01)
*G03G 21/16* (2006.01)

(52) U.S. Cl.
CPC ..... *G03G 15/80* (2013.01); *G03G 21/1619* (2013.01)

(58) Field of Classification Search
CPC ..... G03G 15/80; G03G 21/1619
USPC ..... 399/6, 88, 90, 91, 107
See application file for complete search history.

(56) References Cited

U.S. PATENT DOCUMENTS 5,887,226 A * 3/1999 Taki ..... 399/92
6,975,814 B2 * 12/2005 Tsusaka et al. ..... 399/6
7,403,741 B2 7/2008 Yoshihara et al.
7,513,500 B2 4/2009 Itoh
7,599,641 B2 10/2009 Yoshihara et al.
2004/0096229 A1 5/2004 Yoshihara et al.
2007/0002397 A1 * 1/2007 Osakabe et al. ..... 358/474
2007/0047999 A1 3/2007 Itoh
2007/0230988 A1 * 10/2007 Nobe et al. ..... 399/88
2008/0187349 A1 8/2008 Yoshihara et al.
2011/0076047 A1 * 3/2011 Nobe et al. ..... 399/88

FOREIGN PATENT DOCUMENTS

JP H08-297386 A 11/1996
JP 2002-268309 A 9/2002
JP 2004-093708 A 3/2004
JP 2005-037706 A 2/2005
JP 2007-065178 A 3/2007
JP 2007-152609 A 6/2007
JP 2009-092790 A 4/2009
JP 2011-249700 A 12/2011

* cited by examiner

*Primary Examiner* — Francis Gray
(74) *Attorney, Agent, or Firm* — Banner & Witcoff, Ltd.

(57) ABSTRACT

An image forming apparatus includes an image forming portion, a first side frame and a second side frame facing each other and supporting a part of the image forming portion, a lower frame connecting the first side frame and the second side frame below the image forming portion, a lower voltage power supply board including a low voltage circuit configured to lower a voltage from an external power supply to a specified voltage and supply the specified voltage to other units, and a cover. The lower frame has an upper surface facing upward and includes a plurality of fixing portions. The low voltage power supply board is fixed to the fixing portions of the lower frame. The cover covers the lower voltage power supply board on a side thereof opposite to the lower frame.

8 Claims, 8 Drawing Sheets

IMAGE FORMING APPARATUS WITH LOW VOLTAGE POWER SUPPLY BOARD AND FRAME

CROSS REFERENCE TO RELATED APPLICATION

This application claims priority from Japanese Patent Application No. 2012-202802, filed on Sep. 14, 2012, which is incorporated herein by reference in its entirety.

FIELD

Aspects of the disclosure relate to an image forming apparatus including an image forming portion configured to form an image on a recording medium, more specifically to the image forming apparatus including a low voltage power supply board disposed below the image forming portion, the low voltage power supply board including a low voltage circuit configured to lower a voltage supplied from an external power supply to a specified voltage and supply the voltage to other apparatus.

BACKGROUND

Generally, a known image forming apparatus includes a pair of side frames facing each other and an image forming portion configured to form an image on a recording medium and supported by the pair of side frames. The image forming apparatus may further include a lower frame that connects the pair of side frames below the image forming portion. The lower frame may be provided with some circuit boards such as a drive-control circuit board.

In a case where the lower frame is provided with a low voltage power supply board including a low voltage circuit configured to lower a voltage supplied from an external power supply to a specified voltage and supply the voltage to other apparatus, the low voltage circuit board needs to be covered with a shield member made of metal or a flame retardant resin. In other words, such a low voltage power supply board needs to be covered with a shield member made of sheet metal or a flame-retardant resin to constitute a fireproof enclosure so as to prevent spread of fire in case of the ignition of electronic components such as a capacitor. It is proposed that a drive control circuit board including such a low voltage power supply board is fixed on a sheet metal shield, which is fixed to the lower frame from below with a surface of the sheet metal shield on which the drive control circuit board is fixed facing up.

SUMMARY

However, when the low voltage power supply board is fixed on the lower frame from below, a main body frame in which the pair of side frames and the lower frame are assembled need to be turned upside down, which impairs the workability in a manufacturing process of the image forming apparatus. In addition, the sheet metal shield is unleveled to fix the low voltage power supply board thereto and thus required to have a certain height.

Illustrative aspects of the disclosure provide an image forming apparatus including a low profile lower frame for fixing a low voltage power supply board, which connects a pair of side frames that support an image forming portion.

According to an aspect of the disclosure, an image forming apparatus includes: an image forming portion configured to form an image to be transferred on a recording medium; a first side frame and a second side frame disposed facing each other and supporting at least a part of the image forming portion therebetween; a lower frame connecting the first side frame and the second side frame below the image forming portion, the lower frame having an upper surface facing upward and including a plurality of fixing portions; a low voltage power supply board fixed to the plurality of fixing portions of the lower frame and including a low voltage circuit configured to lower a voltage from an external power supply to a specified voltage and supply the specified voltage to other units; and a cover fixed to at least one of the first side frame, the second side frame, and the lower frame, the cover covering the low voltage power supply board on a side thereof opposite to the lower frame.

BRIEF DESCRIPTION OF THE DRAWINGS

Illustrative aspects will be described in detail with reference to the following figures in which like elements are labeled with like numbers and in which.

DETAILED DESCRIPTION

An illustrative embodiment will be described in detail with reference to the accompanying drawings. The disclosure applies to an electrophotographic image forming apparatus configured to form a color image.

A general structure of an image forming apparatus 1 will be described.

Figure 1:
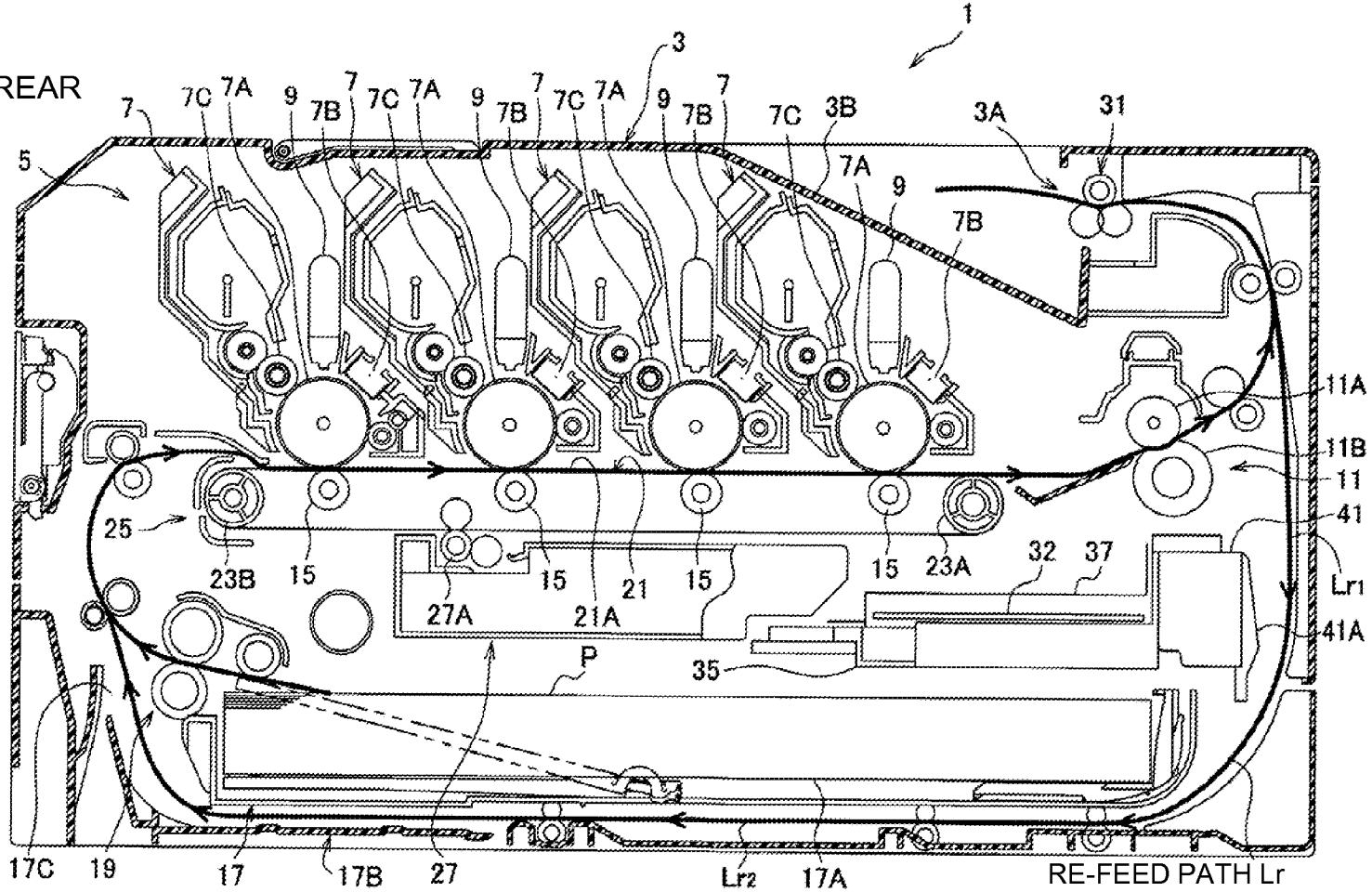
FIG. 1 is a sectional view of an illustrative image forming apparatus according to an embodiment of the disclosure.

As shown in FIG. 1, the image forming apparatus 1 includes a main casing 3 and an image forming portion 5 configured to form an image on a sheet S as an example of a recording medium. The image forming portion 5 mainly includes process units 7, light exposure units 9, and a fixing unit 11, and is configured to form a developer image to be transferred on the sheet P electrophotographically. In the following description, in FIG. 1, the left side is referred to as the front or front side of the image forming apparatus 1, and the right side is referred to as a rear or rear side of the image forming apparatus 1.

The image forming portion 5 of the image forming apparatus 1 is of a direct tandem type where a plurality of, e.g. four, process units 7 are disposed in series along a sheet feed direction where the sheet P is fed. Each process unit 7 is different in color of developer to store therein and identical in structure. Specifically, each process unit 7 has a photosensitive drum 7A on which a developer image is carried, a charger 7B that charges the photosensitive drum 7A, and a developing roller 7C that supplies developer to the photosensitive drum 7A.

In each process unit 7, the photosensitive drum 7A charged by the charger 7B is exposed by the light exposure unit 9, and an electrostatic latent image is formed on a surface of the photosensitive drum 7A. The developer is supplied from the developing roller 7C to the surface of the photosensitive drum 7A on which the electrostatic latent image is formed, and a developer image to be transferred to the sheet P is formed on the photosensitive drum 7A.

The light exposure units 9 each have a number of light-emitting bodies arranged in parallel with an axial direction of the photosensitive drums 7A. The light exposure units 9 are provided in a one-to-one correspondence with the photosensitive drums 7A. In this embodiment, light-emitting diodes, LEDs, are used as light-emitting bodies.

Transfer members 15 configured to transfer the developer images carried on the photosensitive drums 7A on the sheet P are disposed opposite to the photosensitive drums 7A via an extension surface 21A of a transfer conveying belt 21. The developer images carried on the photosensitive drums 7A are overlaid one over the other on the sheet P to be conveyed on the transfer conveying belt 21.

The transfer conveying belt 21 is an endless belt and extends at least around a drive roller 23A and a driven roller 23B. The extension surface 21A is one of a pair of surfaces extending around the drive roller 23A and the driven roller 23B in a direction parallel to a direction where the photosensitive drums 7A are arranged and facing the photosensitive drums 7A.

The transfer conveying belt 21, the drive roller 23A, the driven roller 23B, and a frame (now shown) supporting the drive roller 23A and the driven roller 23B are unitized as a part or module. The module is referred to as a belt unit 25.

The fixing unit 11 is disposed in vicinity of one end of the extension surface 21A in a moving direction thereof. The fixing unit 11 has a heat roller 11A and a pressure roller 11B. The heat roller 11A is configured to rotate while heating the developer images transferred onto the sheet S. The pressure roller 11B is configured to press the sheet P against the heat roller 11A. Thus, the developer images transferred onto the sheet S are heated at the fixing unit 11 and thermally fixed to the sheet S. The sheet S ejected from the fixing unit 11 is fed toward an ejection portion 3A disposed in an upper portion of the main casing 3 while its sheet feeding direction is changed by substantially 180 degrees, and ejected from the ejection portion 3A onto an ejection tray 3B disposed in the upper portion of the main casing 3.

A belt cleaner 27 is disposed on an opposite side of the belt unit 25 to the photosensitive drums 7A and is configured to remove foreign matter adhered to the transfer conveying belt 21. The belt cleaner 27 includes a cleaning roller 27A configured to rotate while in contact with one of a pair of extension surfaces, which is opposite to the extension surface 21A.

A sheet tray 17 is disposed under the belt cleaner 27. The sheet tray 17 has a receiving portion 17A on which a stack of sheets P is received. The sheets P received on the receiving portion 17A are singly fed to the transfer conveying belt 21 by a feeder mechanism 19.

The image forming apparatus 1 according to the embodiment has a double-sided printing function to form images on both front and back sides of a sheet P. When the double-sided printing function is executed, a sheet P having an image formed on one side (hereinafter referred to as a front side) thereof is re-fed to the image forming portion 5 and an image is newly formed on the other side (hereinafter referred to as a back side) of the sheet S.

In other words, the ejection portion 3A includes an ejection roller 31 configured to change its rotational direction between a case where a sheet P fed from the fixing unit 11 is ejected to the ejection tray 3B and a case where sheet feed direction of the sheet P is reversed. In a single-sided printing where an image is formed only on the front side of a sheet P, the ejection roller 31 is configured to rotate such that the sheet P fed from the fixing unit 11 is ejected to the ejection tray 3B. Thus, the sheet P having an image only on the front side thereof is ejected onto the ejection tray 3B.

In the double-sided printing, when a specified period of time elapses after a trailing end, in the sheet feed direction, of the sheet P having an image formed on the front side thereof is separated from the fixing unit 11, the rotation direction of the ejection roller 31 is reversed. Thus, the feed direction is reversed and the sheet P is re-fed via a re-feed path Lr to the image forming portion 5. When the image is formed on the back side of the sheet P, the sheet P is ejected from the ejection portion 3A to the ejection tray 3B without its sheet feed direction being reversed.

The re-feed path Lr is comprised of a first re-feed path Lr1 heading from the ejection roller 31 toward the sheet tray 17 and a second re-feed path Lr2 extending from the first re-feed path L1 via the lower part of the receiving portion 17A to an entrance to the feeder mechanism 19. The second re-feed path Lr2 is defined by a re-feed unit 17B assembled to the lower surface of the sheet tray 17 and a re-feed path exit 17C provided near the feeder mechanism 19. That is, the sheet tray 17 defines a part of the re-feed path Lr.

A low voltage power supply board 32 is disposed in a space below the fixing unit 11 and above the sheet tray 17. The following will describe a structure of a frame supporting the low voltage power supply board 32 with reference to FIG. 2.

Figure 2:
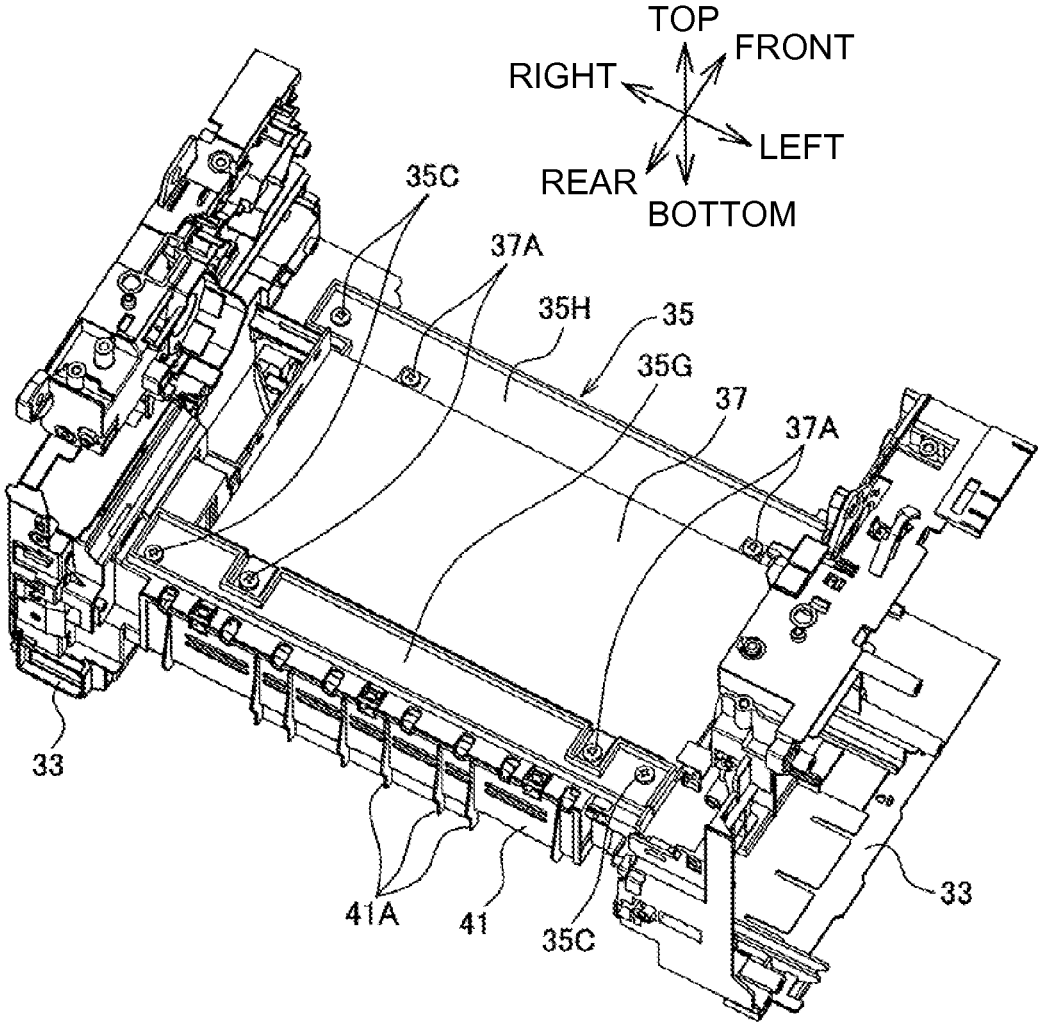
FIG. 2 is a perspective view illustrating a frame structure for a low voltage power supply board of the image forming apparatus.

As shown in FIG. 2, a pair of side frames 33 constituting a main body frame of the image forming apparatus 1 are spaced apart horizontally and disposed facing each other. The pair of side frames 33 are plate-like in shape and made of resin and each integrally include a plurality of reinforcing protrusions protruding from their surfaces. Each side frame 33 has a support portion that supports the process units 7, and is disposed over the full range of the image forming apparatus 1 in the front-rear direction. FIG. 2 illustrates only rear end portions of the side frames 33 supporting the low voltage power supply board 32.

Figure 3:
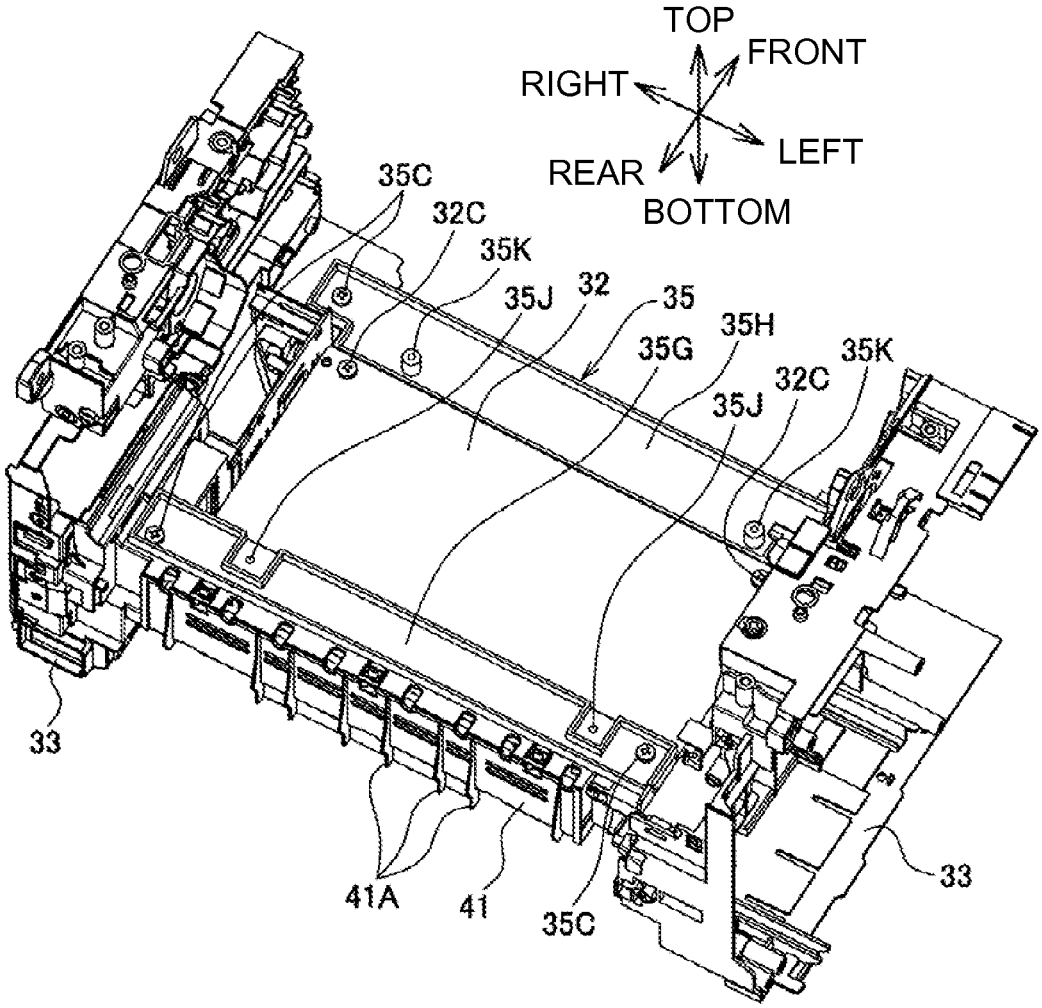
FIG. 3 is a perspective view illustrating the frame structure from which a low voltage power supply cover is removed.

The side frames 33 are connected by a plurality of sub frames (not shown). The sub frames includes a low voltage power supply frame 35 shown in FIG. 2, which is a lower frame connecting the side frames 33 at the lower portions thereof. The low voltage power supply frame 35 is covered, from above, with a low voltage power supply cover 37 as an example of a cover. When the low voltage power supply cover 37 is removed, the low voltage power supply board 32 is exposed as shown in FIG. 3.

Figure 4A:
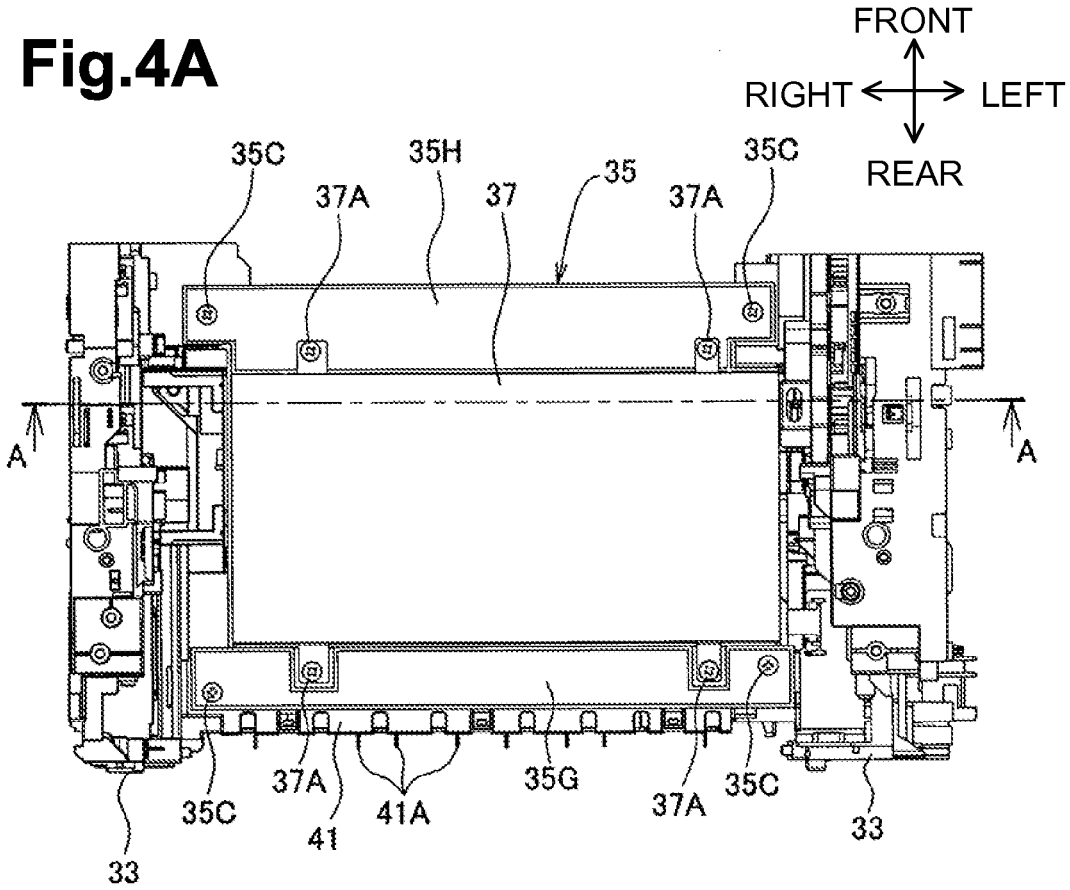
FIG. 4A is a top view of the frame structure.
Figure 4B:
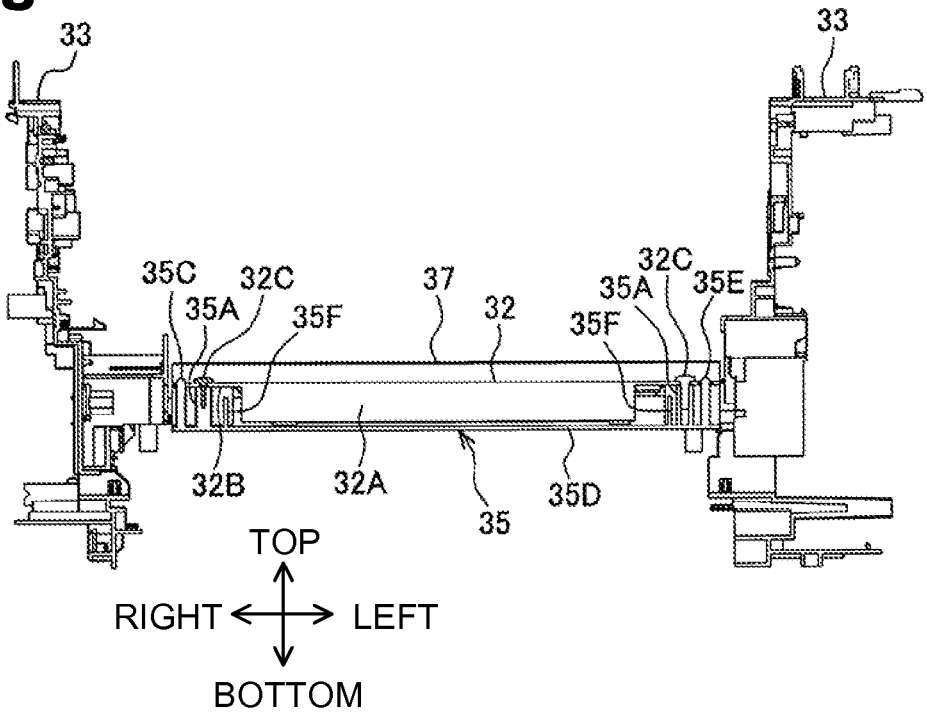
FIG. 4B is a sectional view of the frame structure.
Figure 5:
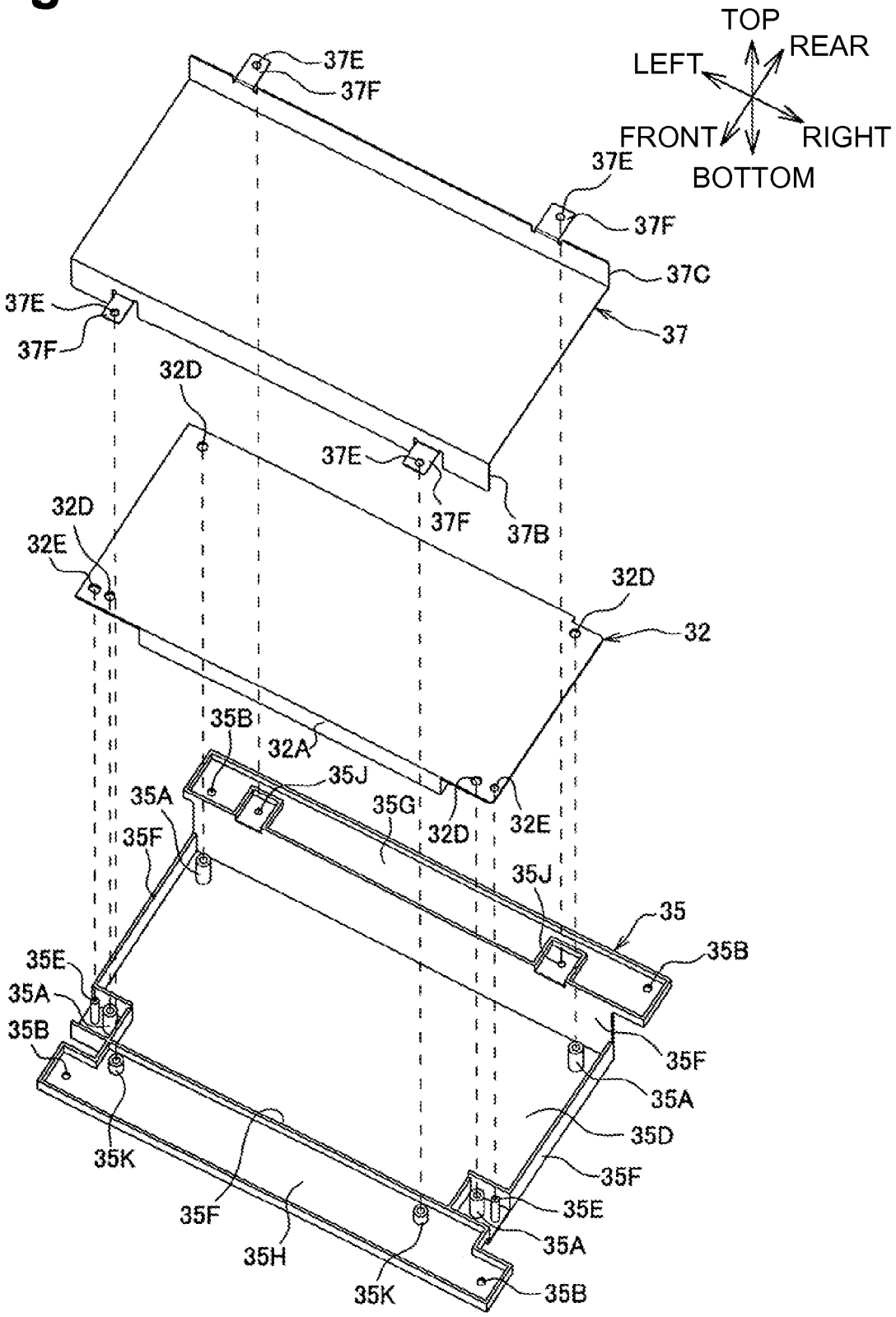
FIG. 5 is an exploded perspective view illustrating the low voltage power supply board and its support structure.

As shown in FIG. 4B, which is a sectional view taken along the line A-A of a plan view shown in FIG. 4A, bosses 35A stand in the low voltage power supply frame 35. Specifically the bosses 35A stand in vicinity of four corners of the low voltage power supply frame 35 as shown in FIG. 5. The low voltage power supply board 32 is fixed to the bosses 35A by screws 32C with an electronic component surface 32B having electronic components 32A mounted thereon facing down, such that the low voltage power supply board 32 is separated upward from the upper surface of the low voltage power supply frame 35. The low voltage power supply cover 37 is fixed to the low voltage power supply frame 35 by screws 37A (FIGS. 2 and 4A) to entirely cover the low voltage power supply board 32 from above.

A circuit comprised of the electronic components 32A mounted on the low voltage power supply board 32 includes a low voltage circuit that drops a voltage from an external power supply to a specified voltage to supply the voltage to other devices in the image forming apparatus 1, such as a motor and an electronic control unit (ECU), which are not shown. In FIG. 4B, the right screw 32C is shown in cross section while the left screw 32C is not shown in cross section. This is because, as shown in FIG. 5, the left and right bosses 35A disposed on the front side of the low voltage power supply frame 35 are located differently in the front-rear direction.

Figure 6A:
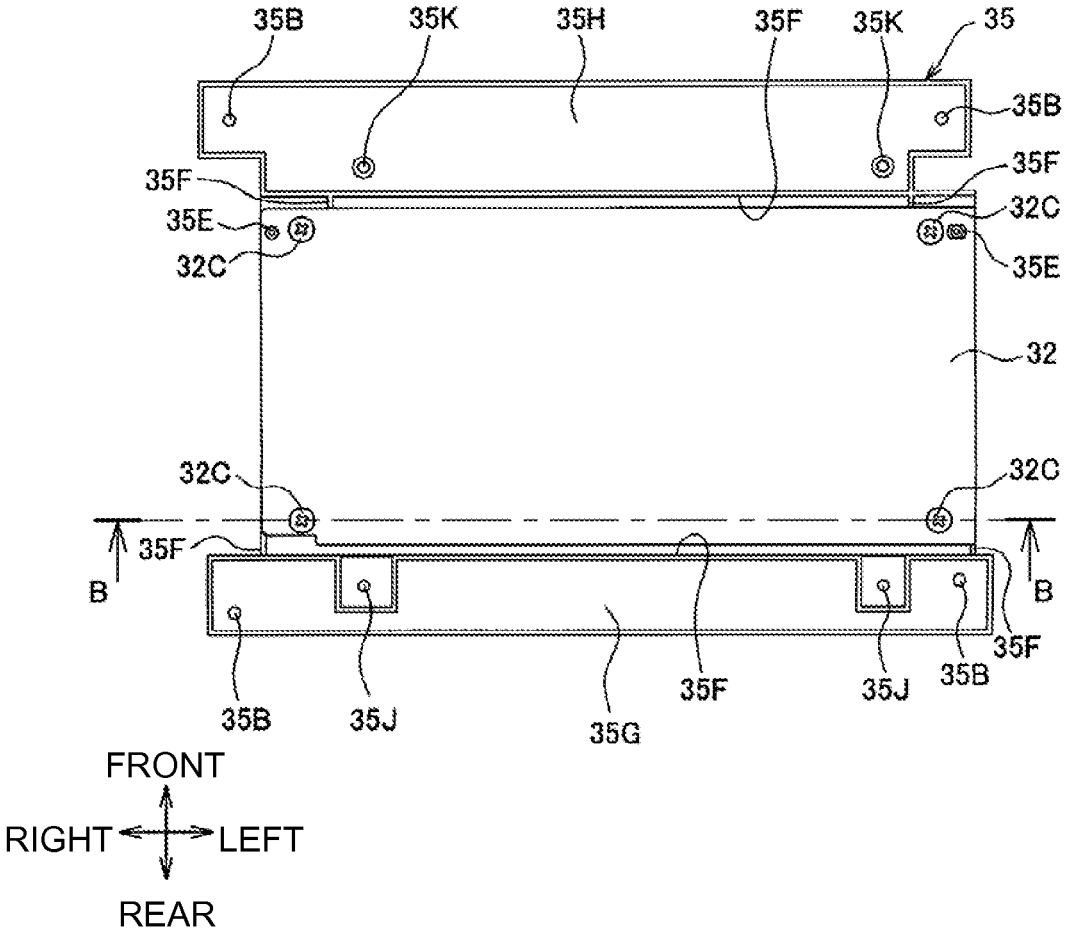
FIG. 6A is a top view illustrating the low voltage power supply board and its support structure.

A supporting structure of the low voltage power supply board 32 will be described with reference to FIGS. 5, 6A, and 6B. As shown in FIG. 5, the low voltage power supply frame 35 is of substantially rectangular configuration having a short side extending in the front-rear direction and a long side extending in the left-right direction. The low voltage power supply frame 35 is fixed to the pair of side frames 33 by inserting four screws 35C (FIG. 2) into screw holes 35B provided in four corners of the low voltage power supply frame 35. The side frames 33 are spaced uniformly by the low voltage power supply frame 35. The low voltage power supply frame 35 is made of a flame-retardant resin having adequate strength. Thus, the main body frame, which is constituted by the side frames 33 and the low voltage power supply frame fixed thereto, possesses adequate structural strength. The low voltage power supply frame 35 further serves to divide the interior of the main body 3 into a space for accommodating the process units 7 and a space for accommodating the sheet tray 17.

As shown in FIG. 2, a cooling duct 41 is disposed between the pair of side frames 33 and in vicinity to positions where the two rear-side screws 35C are inserted. The duct 41 includes, on a surface thereof, ribs 41A defining the re-feed path Lr.

Returning to FIG. 5, the low voltage power supply frame 35 has, in the center thereof in the front-rear direction, a flat-plate like supporting plate 35D located one step down from each screw hole 35B. The bosses 35A stands in the four corners of the supporting plate 35D. The low voltage power supply board 32 has screw holes 32D in positions corresponding to the bosses 35A. The screws 32C are inserted into the screw holes 32D and the bosses 35A respectively, thereby the low voltage power supply board 32 is fixed such that it is separated upward from the upper surface of the supporting plate 35D.

Positioning pins 35E stand outside of the front-side bosses 35A. The low voltage power supply board 32 has positioning holes 32E in which the pins 35E are to be engaged to position the low voltage power supply board 32. In FIG. 5, the right positioning hole 32E is a round hole to position the low voltage power supply board 32 in both of the front-rear direction and the left-right direction, while the left positioning hole 32E is an oval hole wider in the left-right direction to position the low voltage power supply board 32 only in the front-rear direction.

Walls 35F stand around the supporting plate 35D such that the electronic components 32A are horizontally enclosed by the walls 35F when the low voltage power supply board 32 is mounted. The walls 35F stand such that the rear-side screws 35A are disposed inside the walls 35F and the front-side screws 35A are disposed outside the walls 35F. Of the screw holes 35B, the two rear-side screw holes 35B are formed on both ends of a rear bridging portion 35G, which is to be disposed between the side frames 33. The rear bridging portion 35G is higher than the upper end of each boss 35A. The rear wall 35F is higher than the other walls 35F to connect the rear bridging portion 35G. The two front-side screw holes 35B are formed on both ends of a front bridging portion 35H, which is to be disposed between the side frames 33. The front bridging portion 35H is lower than the upper end of each boss 35A as shown in FIG. 6B, and the front wall 35F is low accordingly.

Figure 6B:
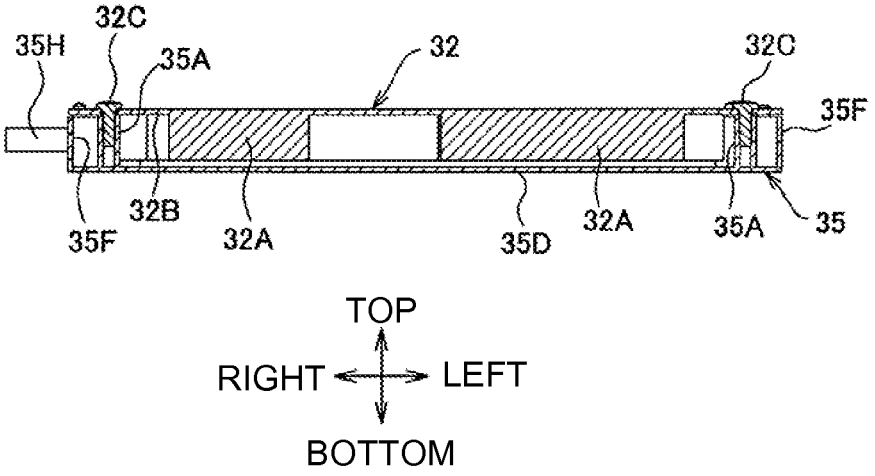
FIG. 6B is a sectional view illustrating the low voltage power supply board and its support structure.

As shown in FIG. 6B, the left and right walls 35F are facing each other and disposed such that a small space between their upper ends and left and right short sides of the low voltage power supply board 32 is provided. The height of each boss 35A is higher than that of electronic components 32A. When the low voltage power supply board 32 is fixed to the bosses 35A as described above, the electronic components 32A is disposed such that it is separated upward from the upper surface of the supporting plate 35D.

As shown in FIG. 5, a front end 37B of the low voltage power supply cover 37 is bent downward and a rear end 37C thereof is bent upward pursuant to a difference of elevation between the rear bridging portion 35G and the front bridging portion 35H. The front end 37B has two tongue pieces 37F protruding therefrom in spaced relation to each other in the left-right direction and the rear end 37C has two tongue pieces 37F protruding therefrom in spaced relation to each other in the left-right direction. The tongue pieces 37F are rectangular-shaped and each have a screw hole 37E therein. The low voltage power supply cover 37 is formed by pressing a metal plate.

The rear bridging portion 35G has a pair of screw holes 35J corresponding to the rear screw holes 37E of the low voltage power supply cover 37 and the front bridging portion 35H has a pair of bosses 35K corresponding to the front screw holes 37E of the low voltage power supply cover 37. Thus, the low voltage power supply cover 37 is fixed to the low voltage power supply frame 35 to cover the low voltage power supply board 32 by fastening the screws 37A into the screw holes 35J and the bosses 35K.

In the image forming apparatus 1 structured as described above, the power supply board 32 and the low voltage power supply cover 37 are fixed in this order from above to the main body frame constituted by fixing the low voltage power supply frame 35 between the side frames 33 with the screws 35C. In other words, the low voltage power supply board 32 is fixed by fastening the screws 35C into the screw holes 32D of the low voltage power supply board 32 and the bosses 35A of the low voltage power supply frame 35, and the low voltage power supply cover 37 is fixed by fastening the screws 37A into the screw holes 37E of the low voltage power supply cover 37 and the screw holes 35J and the bosses 35K of the low voltage power supply frame 35. Thus, in the image forming apparatus 1, various parts can be attached to the low voltage power supply frame 35 from the upper side of the main body frame, which can improve workability in manufacturing processes.

When the low voltage power supply frame 35, the low voltage power supply board 32, and the low voltage power supply cover 37 are fixed to each other, the electronic components 32A on the low voltage power supply board 32 are enclosed around horizontally and vertically with the supporting plate 35D, the walls 35F and the low voltage power supply cover 37, which constitute a shield member. Thus, these parts constituting the shield member function as a fireproof enclosure which can prevent fire from spreading in the event of the electronic components 32A catching fire.

Figure 7A:
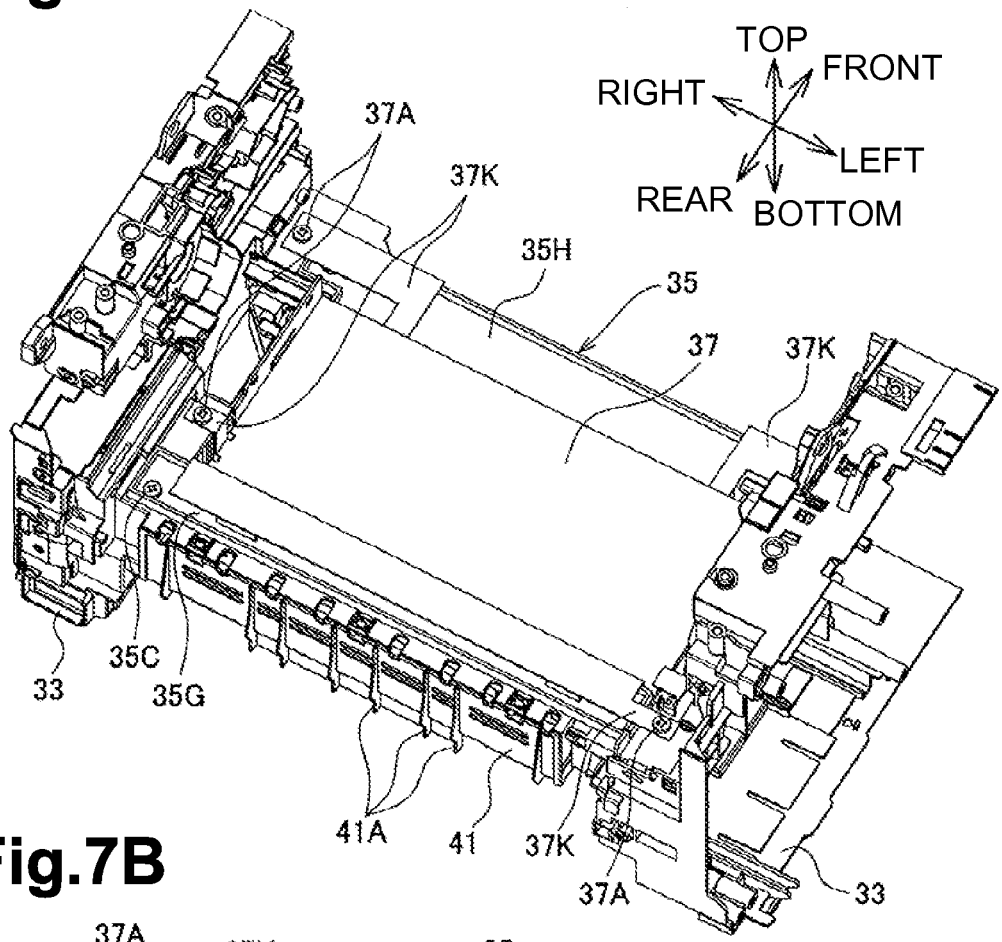
FIG. 7A is a top view illustrating a modification of the low voltage power supply board and its support structure.
Figure 7B:
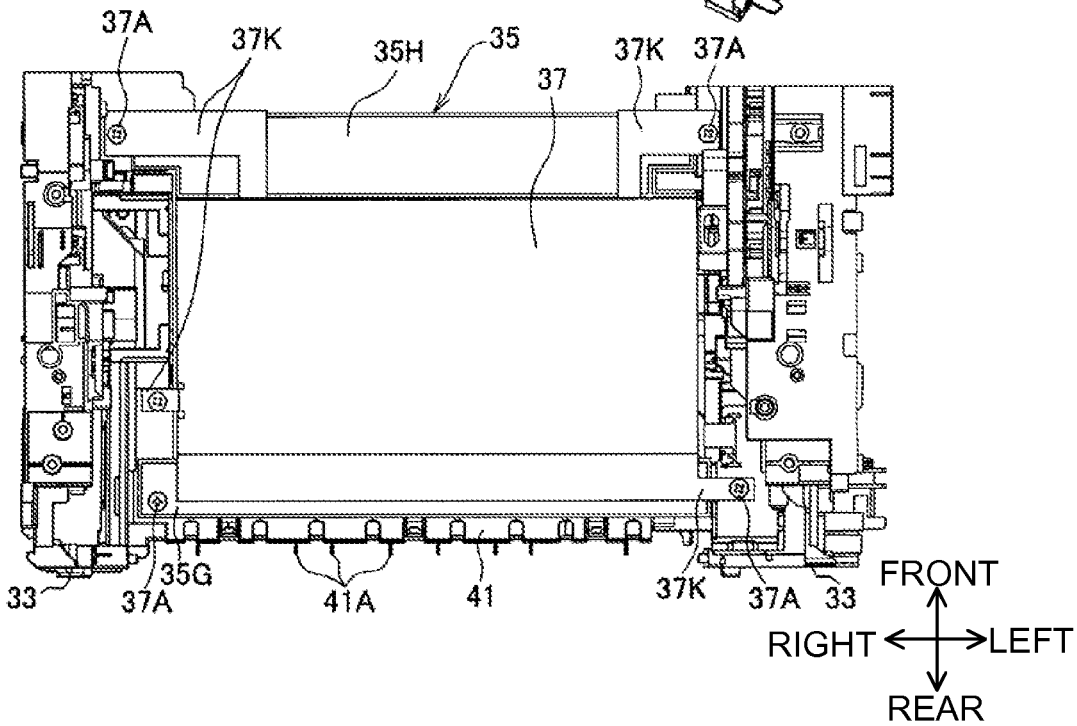
FIG. 7B is a sectional view illustrating the modification of the low voltage power supply board and its support structure.

A modification of the disclosure will be described with reference to FIGS. 7A and 7B.

The low voltage power supply cover 37 includes extension portions 37K protruding at appropriate positions from the edges of the low voltage power supply cover 37 such that the extension portions 37K extend toward the left and right side frames 33. The extension portions 37K each have a screw hole (not shown) into which a corresponding screw 37A is fastened to fix the low voltage power supply cover 37 to the left and right side frames 33. Thus, the low voltage power supply cover 37 can be directly fixed to the side frames 33 in the modification, while it is fixed to the low voltage power supply frame 35 in the above embodiment. It is to be desired that the low voltage power supply cover 37 is directly fixed to the low voltage power supply cover 37 when it is necessary to improve accuracy of attaching the low voltage power supply cover 37 to the side frames 33, for example, when the low voltage power supply cover 37 is required to further function as a chute for guiding sheets. The low voltage power supply cover 37 may be fixed to both the side frames 33 and the low voltage power supply frame 35.

Figure 8A:
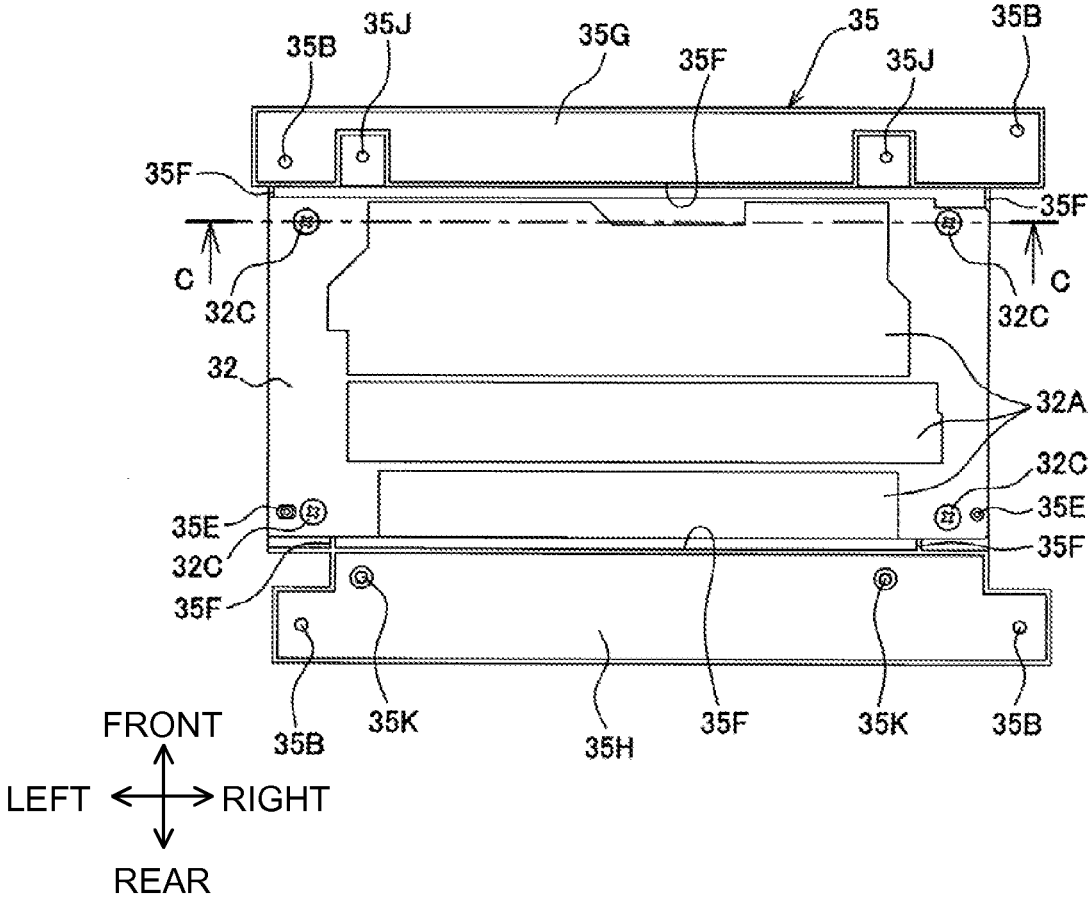
FIG. 8A is a top view illustrating a modification of the low voltage power supply board and its support structure.
Figure 8B:
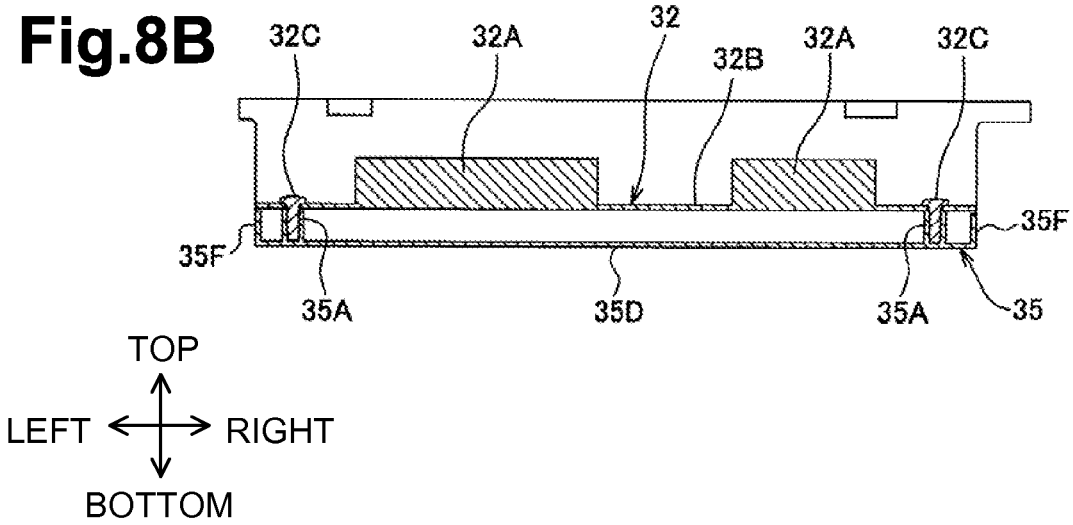
FIG. 8B is a sectional view illustrating the modification of the low voltage power supply board and its support structure.

Another modification of the disclosure will be described with reference to FIGS. 8A and 8B.

The low voltage power supply board 32 is fixed to the low voltage power supply frame 35 with the electronic components 32A mounted on the electronic component surface 32B facing upward. In this case, the bosses 35A can be designed to be lower as shown in FIG. 8B. However, the low voltage power supply frame 35 can be made more lower in height when the electronic components 32A are mounted on the lower surface of the low voltage power supply board 32 and overlap the bosses 35A as viewed horizontally, as shown in FIG. 6. Thus, in the above embodiment, the height of the low voltage power supply frame 35 can be made lower and the image forming apparatus 1 can be made more compact. The electronic components 32A do not necessarily have to be covered around horizontally. The low voltage power supply board 32 may be vertically sandwiched between parts functioning as fire barriers.

The above embodiments show, but are not limited to, the image forming apparatus 1 of electrophotographic type described above. The above embodiments may apply to intermediate transfer-type image forming apparatuses, monochrome image forming apparatuses, and ink jet-type image forming apparatuses.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

an image forming portion configured to form an image to be transferred on a recording medium;

a first side frame and a second side frame disposed facing each other and supporting at least a part of the image forming portion therebetween;

a lower frame connecting the first side frame and the second side frame below the image forming portion, the lower frame having an upper surface facing upward and including a plurality of bosses protruding from the upper surface toward the image forming portion;

a low voltage power supply board fixed to the plurality of bosses protruding from the upper surface of the lower frame, the low voltage power supply board including a low voltage circuit configured to lower a voltage from an external power supply to a specified voltage and supply the specified voltage to other units; and a cover fixed to at least one of the first side frame, the second side frame, and the lower frame, the cover covering an upper surface of the low voltage power supply board fixed to the plurality of bosses protruding from the upper surface of the lower frame.

2. The image forming apparatus according to claim 1, wherein the low voltage power supply board is fixed to the bosses protruding from the upper surface of the lower frame such that the low voltage power supply board spaced upward from the upper surface of the lower frame, and wherein the low voltage power supply board has an electronic component surface facing the upper surface of the lower frame.

3. The image forming apparatus according to claim 2, wherein the lower frame includes a plurality of walls standing on the upper surface such that electronic components mounted on the electronic component surface are horizontally enclosed by the walls, and at least a part of upper ends of the walls contacts or faces the low voltage power supply board.

4. The image forming apparatus according to claim 1, wherein the cover is fixed to the lower frame.

5. The image forming apparatus according to claim 1, wherein the cover is fixed to the first side frame and the second side frame.

6. The image forming apparatus according to claim 1, wherein the lower frame is made of a flame-retardant resin.

7. The image forming apparatus according to claim 1, wherein the cover entirely covers the upper surface of the low voltage power supply board.

8. The image forming apparatus according to claim 1, comprising:

a sheet tray disposed below the lower frame and configured to accommodate the recording medium to be fed to the image forming portion; and a belt unit disposed between the image forming portion and the sheet tray, the belt unit including an endless belt disposed above the cover and below the image forming portion, wherein the image forming portion includes a photosensitive drum configured to contact the endless belt.

* * * * *